United States Patent [19]

Hannen et al.

[11] Patent Number: 4,866,916

[45] Date of Patent: Sep. 19, 1989

[54] APPARATUS FOR SHRINK-WRAPPING PALLETTED GOODS

[75] Inventors: Reiner Hannen, Goch-Pfalzdorf; Norbert Vermeulen, Kleve-Warbeyen, both of Fed. Rep. of Germany

[73] Assignee: MSK-Verpackungs-Systeme Gesellschaft Mit Beschrankter Haftung, Kleve, Fed. Rep. of Germany

[21] Appl. No.: 203,218

[22] Filed: Jun. 6, 1988

[30] Foreign Application Priority Data

Jun. 6, 1987 [DE] Fed. Rep. of Germany ... 8708145[U]

[51] Int. Cl.[4] ..... B65B 9/10; B65B 53/06

[52] U.S. Cl. ..... 53/557; 53/442; 53/567

[58] Field of Search ..... 53/442, 557, 567

[56] References Cited

U.S. PATENT DOCUMENTS 4,050,219 9/1977 Higgins ..... 53/567

4,724,658 2/1988 Birkenfeld et al. ..... 53/567

FOREIGN PATENT DOCUMENTS 0133462 7/1987 European Pat. Off. .

*Primary Examiner*—W. Donald Bray

*Attorney, Agent, or Firm*—Herbert Dubno

[57] ABSTRACT

The apparatus for shrinking a shrinkable cover to enclose a palletted stack of goods comprises a shrinking device, a conveying system for the palletted stack of goods transported past the shrinking device, a lifting device positioned under the shrinking device for raising the palletted stack of goods and a suction device positioned in the vicinity of the lifting device. The lifting device is located astride the path of the conveyor system thereby eliminating below ground conveyors in favor of driverless automatically controlled floor conveying devices. Part of the lifting device is at least one raisable and lowerable support movable under a palletted stack of goods being guided on the conveyor system. The support has seat members projecting from it for the palletted stack of goods and the seat members are movable from a horizontal into a vertical orientation, especially by rotation of the support about its longitudinal axis.

7 Claims, 1 Drawing Sheet

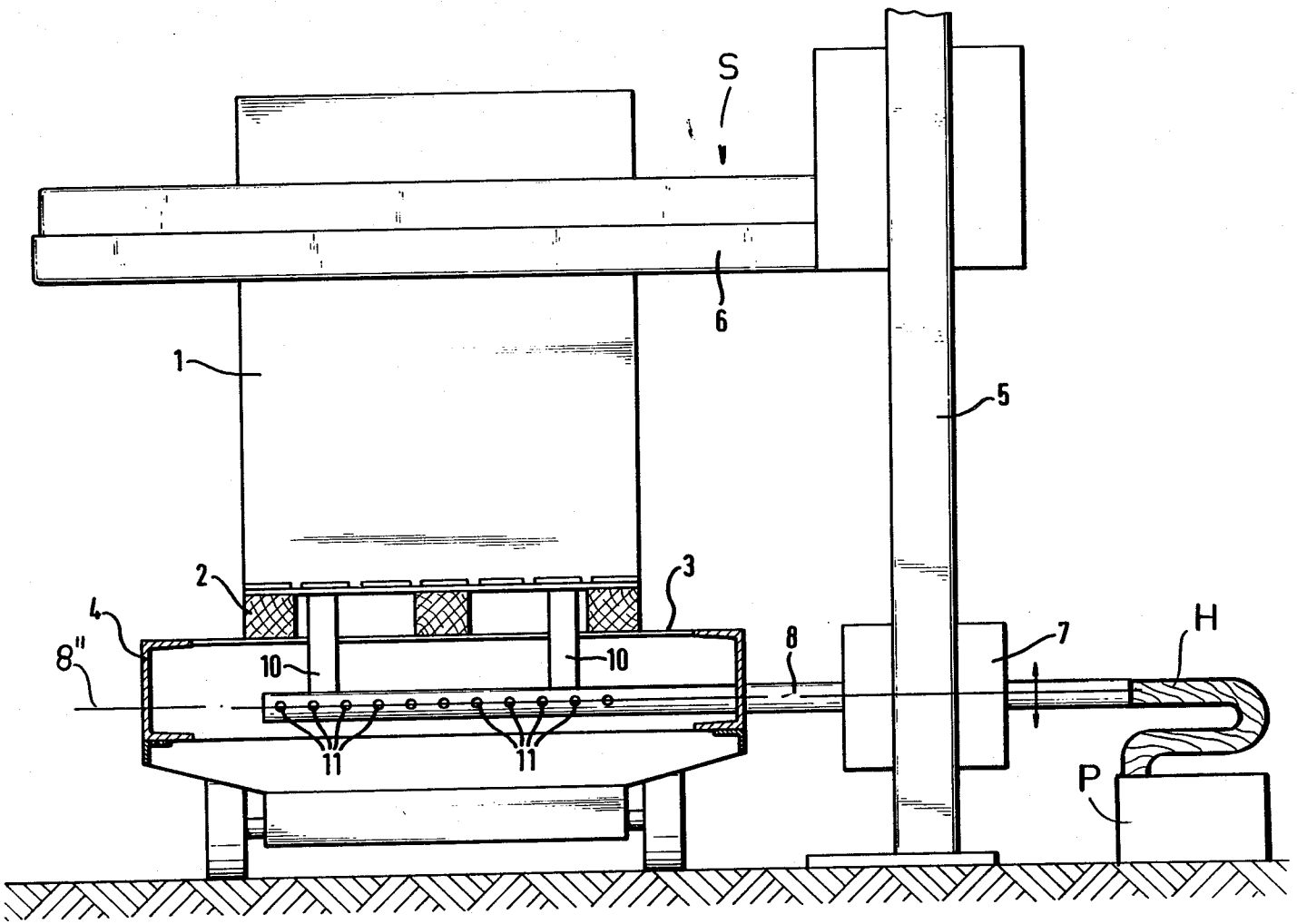
H
P
7
5
8
S
6
3
10
11
11
10
2
1
4
8"

APPARATUS FOR SHRINK-WRAPPING PALLETTED GOODS

CROSS REFERENCE TO RELATED PATENTS

This application is related to the following issued patents; U.S. Pat. Nos. 4,562,689; 4,616,471 and 4,651,508.

FIELD OF THE INVENTION

Our present invention relates to an apparatus for shrink-wrapping palletted goods with a thermoplastic heat-shrinkable foil, i.e. for shrinking a foil covering on a palletted stack of goods.

BACKGROUND OF THE INVENTION

An apparatus for shrinking a cover onto a palletted stack of goods can comprise a shrinking device, a conveying system for the pallatted stack of goods transported past the shrinking device, a lifting device positioned under the shrinking device for raising the palletted stack of goods and a suction device or air pump located in the vicinity of the lifting device.

In an apparatus for this purpose as described in European Open Patent Application 0 133 462 the palletted stack of goods, if necessary already provided with a heat-shrinkable cover foil, is transported on a conveyor, e.g. a roller conveyor, until it reaches the vicinity of the shrinking device.

There the palletted stack of goods is lifted with a lifting device, which is formed as a scissors lift table positioned under the conveyor, so that the lower edges of the shrinkable cover hang freely over the lower side of the pallette.

The suction device located on the scissors lift table then draws the free edges of the cover against the lower side of the pallette and the wrap is shrunk onto the stack by the shrinking device (e.g. a hot air blower) so that a so-called undershrunk portion is formed. Then the palletted stack of goods again is taken away on the roller conveyor and the remainder of the shrinkable cover foil is shrunk snugly against the stack.

A driverless conveyor system with electric tractors and carts moved by it are used for the transport of goods inside the factory. The electric tractors are guided and controlled by an induction loop located below the floor, i.e. they are also started and stopped using it. Using this transport or conveyor system together with a shrinking device, the lifting device and the suction device must be located under the floor so that the electric tractor can bring the stack of goods located on the cart under the shrinking device. For such purposes there is required an expensive construction and assembly for the lifting device and the suction device or air pump.

OBJECT OF THE INVENTION

It is an object of our invention to provide an improved apparatus for shrinking a shrinkable cover over a stack of goods which does not have the abovementioned disadvantage.

It is also an object of our invention to provide an improved apparatus for shrinking a shrinkable cover on a stack of goods which does not require the previously employed systems located below the floor including special driverless automatically controlled floor conveyor devices.

SUMMARY OF THE INVENTION

These objects and others which will become more readily apparent hereinafter are attained in accordance with our invention in an apparatus for shrinking a shrinkable cover over a palletted stack of goods comprising a shrinking device, a conveying system for transporting the palletted stack of goods past the shrinking device, a lifting device positioned under the shrinking device for raising the palletted stack of goods and a suction device positioned in the vicinity of the lifting device.

According to our invention the lifting device is positioned adjacent the conveying system and comprises at least one raisable and lowerable support which is movable under the palletted stack of goods transported by the conveyor system. The support has at least two seat members projecting from it and the seat members are movable from a horizontal orientation to a vertical orientation.

The entire lifting device is thus adjacent the path of the conveying system and below the shrinking device so that the effort required for digging a lower level and the machine required for it are superfluous. By suitable control of the movement, on the one hand, of the support and, on the other hand of the seat members, the latter can be brought under the pallette so that with their help the pallette and the stack of goods located on it can be raised from a resting place on the cart. It is understood that the cart and/or the carts on which the palletted stack of goods are guided have resting places or seating locations which are formed so that the seat member or bar can engage on the underside of the pallette.

The control of the pivoting of the seat members is especially simple when two or more supports are provided and the supports are rotatable about their longitudinal axis. Then the seat members can be rigidly attached to the support.

Advantageously the support should be slidable in the direction of its long or longitudinal axis and also transversely to the path of the conveyor system. Moreover the support can be mounted in a drive housing which has drives and guides for the longitudinal displacement of the support and for its rotating motion and which is movable up and down vertically on a stand.

Since in most cases the shrinking device is likewise guided on one or more vertical stands, the drive housing can also be guided on the stand or stands of the shrinking device.

For drawing air under the pallette in one embodiment the supports can comprise pipes which are provided with air holes and are connected to a suction device.

BRIEF DESCRIPTION OF THE DRAWING

The above and other objects, features and advantages of our invention will become more readily apparent from the following description, reference being made to the accompanying highly diagrammatic drawing in which the sole FIGURE is a schematic side elevational view of one embodiment of the apparatus for shrinking a shrinkable cover or wrap over a stack of goods according to our invention.

SPECIFIC DESCRIPTION

The apparatus shown in the drawing functions to shrink a shrinkable cover so that the cover encloses a palletted stack of goods. A stack of goods 1 is positioned on a pallette 2 which is put on a seating surface 3 of a cart 4.

One or more carts are moved by an electric tractor (not shown) which can be controlled, stopped and started by an induction coil laid in the floor of the factory building.

A cart 4 carrying a stack of goods 1 is halted in front of a shrinking device S. This shrinking device S comprises one or more vertical stands 5 on which a shrinking frame 6 is movable up and down. The shrinking frame 6 has an inner opening which is somewhat larger than the cross section of the stack of goods 1. On the inside edge of the opening there are located heating devices, e.g. burners. These burners direct hot combustion gases against the stack of goods 1 so that on moving the shrinking frame 6 up and down a thermoplastic foil cover or wrap enclosing the stack of goods 1.

A drive housing 7 is also guided vertically up and down on the stand 5. Two supports 8 parallel to each other are held in the drive housing 7. Only one of these supports 8 is visible in the drawing. With the help of associated drives which are not shown the support 8 can be pushed in the direction of its longitudinal axis 8″ horizontally so far that it is in the retracted position or located outside of the cart 4. The support 8 can moreover be rotated with the aid of the associated drives about its longitudinal axis 8″.

On the ends directed toward the cart 4 each support 8 has two seat members 10 positioned spaced from each other which project radially from the support 8. By rotating the support 8 the seat members 10 can be brought from a horizontal position into the illustrated vertical position.

The support 8 comprises a pipe with air holes 11 on that segment which is located in the indicated operational position under the pallette 2. The pipelike support 8 is also connected to a suction device P.

The apparatus as follows:

A cart 4 carrying a stack of goods 1 is stopped in front of the shrinking device S.

The support 8 is moved in a direction corresponding to its longitudinal axis 8″ through appropriate openings (not shown) in the cart 4 into the cart 4 until the support 8 is under the the pallette 2. At that time the seat members 10 are located in their horizontal position.

Then the supports 8 are rotated about their longitudinal axes 8″ until the seat members 10 take a substantially vertical position which is shown in the drawing. It is understood that also the seating surface 3 of the car 4 has suitable openings so that the seat members 10 can be swung into the vertical position to grip or engage the underside of the pallette 2 when the support 8 is lifted with the aid of the drive housing 7.

On further lifting of the support 8, the pallette 2 is raised from the seating surface 3 with the stack of goods located on it and of course until the edges of the shrinkable cover drawn over the stack of goods 1 and the pallette 2 (but not shown in the drawing) hang freely until below the underside of the pallette 2.

After the suction device P is turned on, it pulls air through the air holes 11 of the pipe like support 8 from the underside of the pallette, the freely hanging edges of the shrinkable cover are drawn under the underside of the pallette. Now the shrinkable cover can be shrunk on. The pallette 2 with the edges of the shrinkable cover forced under it is then put down on the seating surface 3 again. Alternatively, edges of the cover may be forced by pumped air pressure under the underside of the pallette and shrunken thereon. After the shrinkable cover is completely shrunk on and the pallette is again put on the cart 4, the support 8 is lowered far enough so that the seat members 10 can be brought into the horizontal position again by rotating the support 8. Subsequently the supports 8 are retracted by longitudinally sliding them from the vicinity of the cart 4 which can then travel further.

In the above embodiment of our invention the conveying system includes the carts 4, the unshown electric tractor and the electrical devices required to power and control them.

We claim:

1. An apparatus for shrinking of a shrinkable cover around a palleted stack of goods comprising:
   at least one stand;
   a shrinking device vertically movable along said stand;
   a conveying system for said palletted stack of goods transportable underneath said shrinking device and positionable adjacent said stand;
   a lifting device positioned on one of said stands but located under said shrinking device for raising said palletted stack of goods, said lifting device comprising:
   at least two pipe-like supports attached perpendicular to said stand upon which said lifting device is positioned; and
   at least two seat members projecting from said supports, said seat members being movable from a horizontal orientation to a vertical orientation;
   a suction device positioned in a vicinity of said lifting device.

2. The apparatus defined in claim 1 wherein said at least two supports are rotatable about respective longitudinal axes thereof.

3. The apparatus defined in claim 2 wherein said supports are slidable along said longitudinal axes of said support.

4. The apparatus defined in claim 1 further comprising a drive housing mounted on one of said stands and vertically moveable thereon, at least one of said supports being mounted on said drive housing.

5. The apparatus defined in claim 4 wherein said drive housing is guided on said stand of said shrinking device.

6. The apparatus defined in claim 1 further comprising a plurality of air holes formed along said support and said holes connected to said suction device.

7. An apparatus for shrinking of a shrinkable cover around a palletted stack of goods comprising:
   at least one stand;
   a shrinking device vertically movable along said stand;
   a conveying system for said palletted stack of goods transportable underneath said shrinking device and positionable adjacent said stand;
   a lifting device positioned on one of said stands but located under said shrinking device for raising said palletted stack of goods, said lifting device comprising:
   a drive housing vertically movable on said stand upon which said lifting device is positioned;
   at least two pipe-like supports attached to said housing perpendicular to said housing, each of said supports being rotatable about a longitudinal axis thereof;
   a plurality of air holes formed along said supports; and
   at least two seat members projecting from said supports, said seat members being movable from a horizontal orientation to a vertical orientation; and
   a suction device connected to said plurality of air holes.

* * * * *